US006915572B1

(12) United States Patent
Ritter et al.

(10) Patent No.: US 6,915,572 B1
(45) Date of Patent: Jul. 12, 2005

(54) METHOD AND PLANT FOR CONTINUOUSLY PRODUCING CONSTRUCTION

(75) Inventors: Klaus Ritter, Graz (AT); Gerhard Ritter, deceased, late of Graz (AT); by Ingrid Ritter, legal representative, Graz (AT); Gerhard Schmidt, Graz (AT)

(73) Assignee: EVG Entwicklungs-U. Verwertungs-Gesellschaft mbH, Raaba (AT)

( * ) Notice: Subject to any disclaimer, the term of this patent is extended or adjusted under 35 U.S.C. 154(b) by 0 days.

(21) Appl. No.: 09/807,106

(22) PCT Filed: Oct. 5, 1999

(86) PCT No.: PCT/AT99/00240

§ 371 (c)(1),
(2), (4) Date: Apr. 1, 2002

(87) PCT Pub. No.: WO00/21698

PCT Pub. Date: Apr. 20, 2000

(30) Foreign Application Priority Data

Oct. 9, 1998 (AT) ..... 1692/98

(51) Int. Cl.[7] ..... B23P 17/00; B23P 21/00

(52) U.S. Cl. ..... 29/897.32; 29/897.3; 29/897.34; 29/897.1; 29/430; 29/458; 29/779; 29/782; 29/819; 29/820; 29/791; 29/783

(58) Field of Search ..... 29/897.3, 897.32, 29/897.34, 897.1, 430, 458, 469, 527.3, 779, 782, 819, 820, 791, 783; 52/307.7, 309.9, 649.1; 264/45.8, 46.2, 46.7; 428/309.9

(56) References Cited

U.S. PATENT DOCUMENTS 4,226,067 A 10/1980 Artzer
4,581,186 A * 4/1986 Larson ..... 264/45.8
4,651,494 A * 3/1987 Van Wagoner ..... 52/592.1
5,344,700 A * 9/1994 McGath et al. ..... 428/304.4
5,465,487 A * 11/1995 Dean ..... 29/897.35
5,647,110 A * 7/1997 Ritter et al. ..... 29/33 K
6,062,287 A * 5/2000 Ernest ..... 156/542
6,564,521 B1 * 5/2003 Brown et al. ..... 52/309.11
6,581,348 B2 * 6/2003 Hunter, Jr. ..... 52/408
2002/0069532 A1 * 6/2002 Meilleur ..... 29/897.34

FOREIGN PATENT DOCUMENTS

| | | |
|---|---|---|
| DE | 19 55 409 | 5/1971 |
| DE | 21 50 886 | 4/1973 |
| EP | 0 094 809 | 11/1983 |
| GB | 2 147 331 | 5/1985 |
| WO | WO 94/28264 | 12/1994 |
| WO | WO 96/03234 | 2/1996 |

* cited by examiner

*Primary Examiner*—Marc Jimenez
(74) *Attorney, Agent, or Firm*—Cohen, Pontani, Lieberman & Pavane

(57) ABSTRACT

Method and apparatus for the continuous manufacture of structural members, in which two parallel, flat wire mesh mats comprising longitudinal and transverse wires intersecting with each other and welded together at the points of intersection are advanced on a production line and between the wire mesh mats is introduced an insulating body, whereupon the straight link wires are passed through the insulating body and with their ends welded to the wire mesh mats, so that the latter are held a predetermined distance apart, wherein first an endless, coherent web of insulating material is produced from individual insulating panels and advanced and then the insulating body is cut off this web of insulating material in a selectable length.

15 Claims, 3 Drawing Sheets

METHOD AND PLANT FOR CONTINUOUSLY PRODUCING CONSTRUCTION

Figure 1:
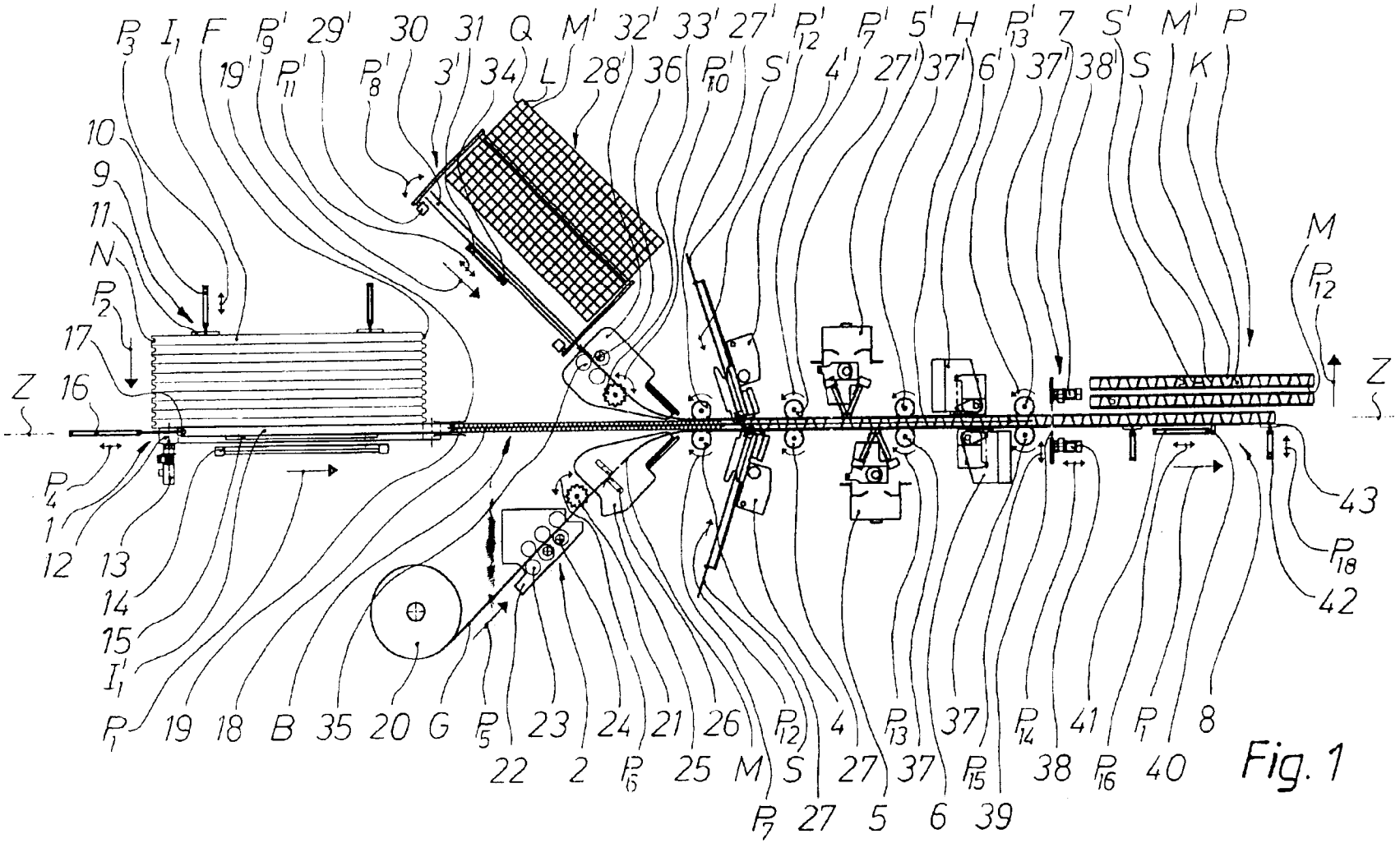

This application is a U.S. National Phase Application under 35 USC 371 of International Application PCT/AT99/00240 (not published in English) filed 5 Oct. 1999.

The invention concerns a method and an apparatus for the continuous manufacture of structural members consisting of two parallel, flat wire mesh mats comprising longitudinal and transverse wires intersecting with each other and welded together at the points of intersection, straight link wires which keep the wire mesh mats a predetermined distance apart, and an insulating body arranged between the wire mesh mats and penetrated by the link wires.

From WO 96/03234 is known an apparatus comprising two storage magazines for wire mesh webs or wire mesh mats, straightening and cutting devices for each wire mesh web, a feeder for insulating panels, at least one assembly of link wire storage reels together with associated link wire feeders and cutting devices, link wire welding devices, link wire trimming devices, and several conveying elements coupled together for the wire mesh webs or wire mesh mats, for the insulating body and for the structural member.

In this known apparatus, two straightened wire mesh webs each taken off a storage reel are divided up into wire mesh mats of the desired length and the wire mesh mats produced in this way are brought into a parallel position with a distance between them corresponding to the desired thickness of the structural member to be manufactured. There is also provision for the feeding of wire mesh mats already cut to length. Into the gap between the wire mesh mats and with a selectable distance from the wire mesh mats is introduced an insulating body which is either separated from a web of insulating material or supplied as a single panel. The two wire mesh mats are fed together with the insulating body to the link wire feeders and cutting devices in which first several wires are simultaneously taken off storage reels in vertical rows one above the other, straightened and divided up into link wires of the required length, and then the link wires are pushed from the side through the holes in the two wire mesh mats and the insulating body, wherein each link wire with its ends comes to lie close to a wire of the wire mesh mats. The half-finished structural member produced in this way is fed to the link wire welding devices-in which the ends of the link wires are welded to the wires of the wire mesh mats. The structural member is finally fed to the trimming devices in which the lateral ends of the link wires projecting beyond the wires of the wire mesh mats are cut off.

The drawback with the known apparatus is that the manufacture of an endless web of insulating material is very expensive and above all the supply of this endless web of insulating material requires very large radii of curvature and therefore a great deal of space, due to the stiffness of the insulating material. The known apparatus moreover gives no indication of the embodiment of the cutting device for the web of insulating material.

It is the object of the invention to provide a method and an apparatus of the kind indicated at the beginning, which avoid the drawbacks described in the known apparatus and make it possible to supply the apparatus with an endless web of insulating material manufactured in a simple manner and to separate the insulating body of the structural member from the web of insulating material in a simple manner.

The invention therefore relates to a method for the continuous manufacture of structural members, in which two parallel, flat wire mesh mats comprising longitudinal and transverse wires intersecting with each other and welded together at the points of intersection are advanced on a production line and between the wire mesh mats is introduced an insulating body, whereupon the straight link wires are passed through the insulating body and with their ends welded to the wire mesh mats, so that the latter are held a predetermined distance apart, characterised in that first an endless, coherent web of insulating material is produced from individual insulating panels and advanced and then the insulating body is cut off this web of insulating material in a selectable length.

Preferably the insulating panels are conveyed singly and successively onto the production line and displaced relative to each other in their longitudinal direction to produce the web of insulating material, with the result that the faces of the adjacent insulating panels are joined together in form-locking and force-locking relationship to form the web of insulating material.

Alternatively it is provided that insulating panels with plane faces are used and, to produce the endless, coherent web of insulating material, an adhesive is applied to at least one face of adjacent insulating panels or the face is provided with a self-adhesive film.

The subject of the invention is further an apparatus for carrying out the method, with two storage magazines for wire mesh webs, with straightening and cutting devices for each wire mesh web, with a feeder for insulating panels, with at least one assembly of link wire storage reels together with associated link wire feeders and cutting devices, with link wire welding devices, with link wire trimming devices, and with several conveying devices coupled together for the insulating body, for the wire mesh webs or for wire mesh mats, for the mesh body and for the structural member, characterised in that an advance mechanism for the displacement of insulating panels relative to a web of insulating material for the purpose of forming a form-locking and force-locking joint between the insulating panels and the web of insulating material, and a cutting device displaceable parallel to the production line for cutting an insulating body off the web of insulating material, are provided. Alternatively the cutting device comprises a cutting wire which is displaceable transversely to the web of insulating material and heatable by means of a heating transformer.

Figure 2:
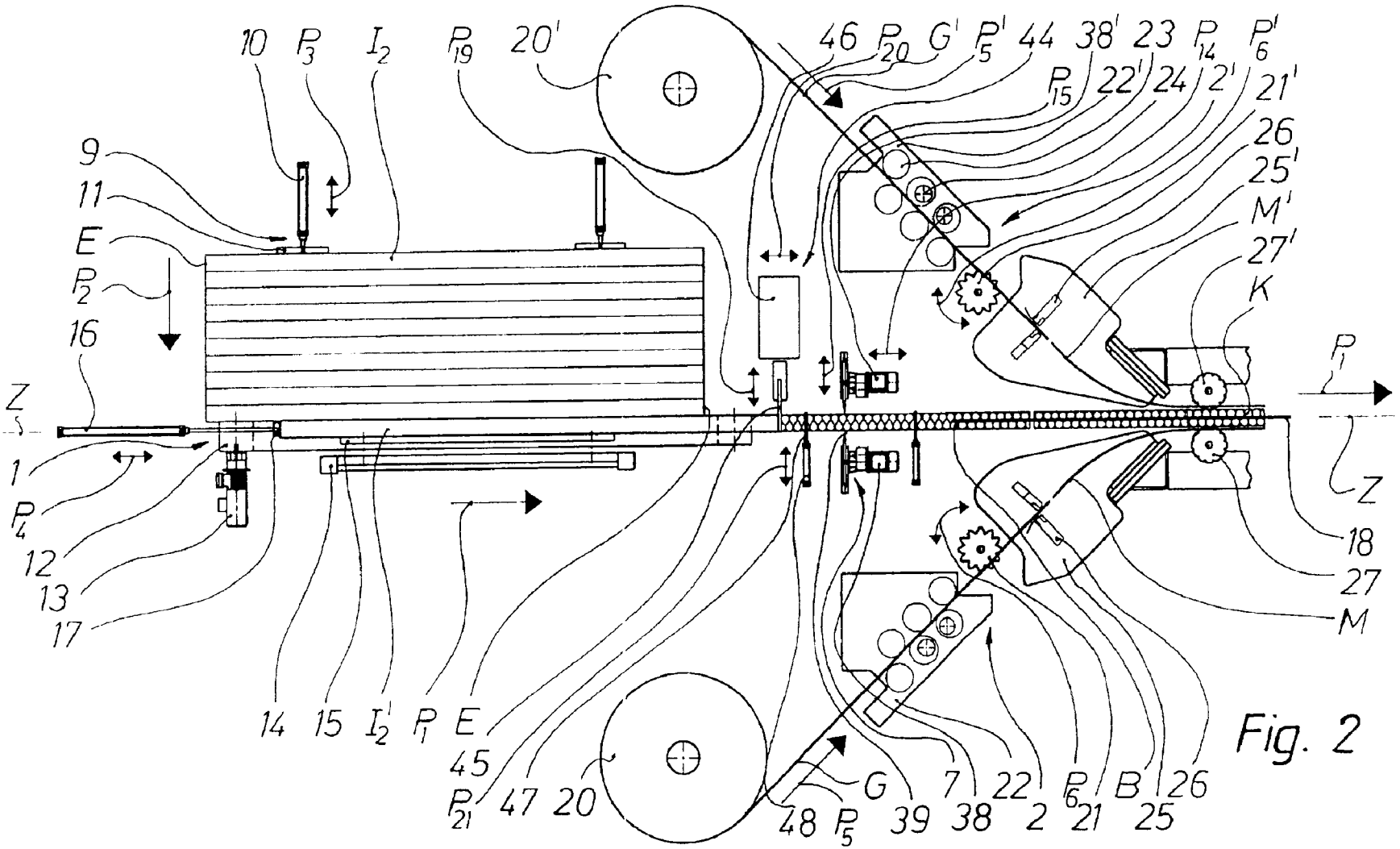
Figure 3:
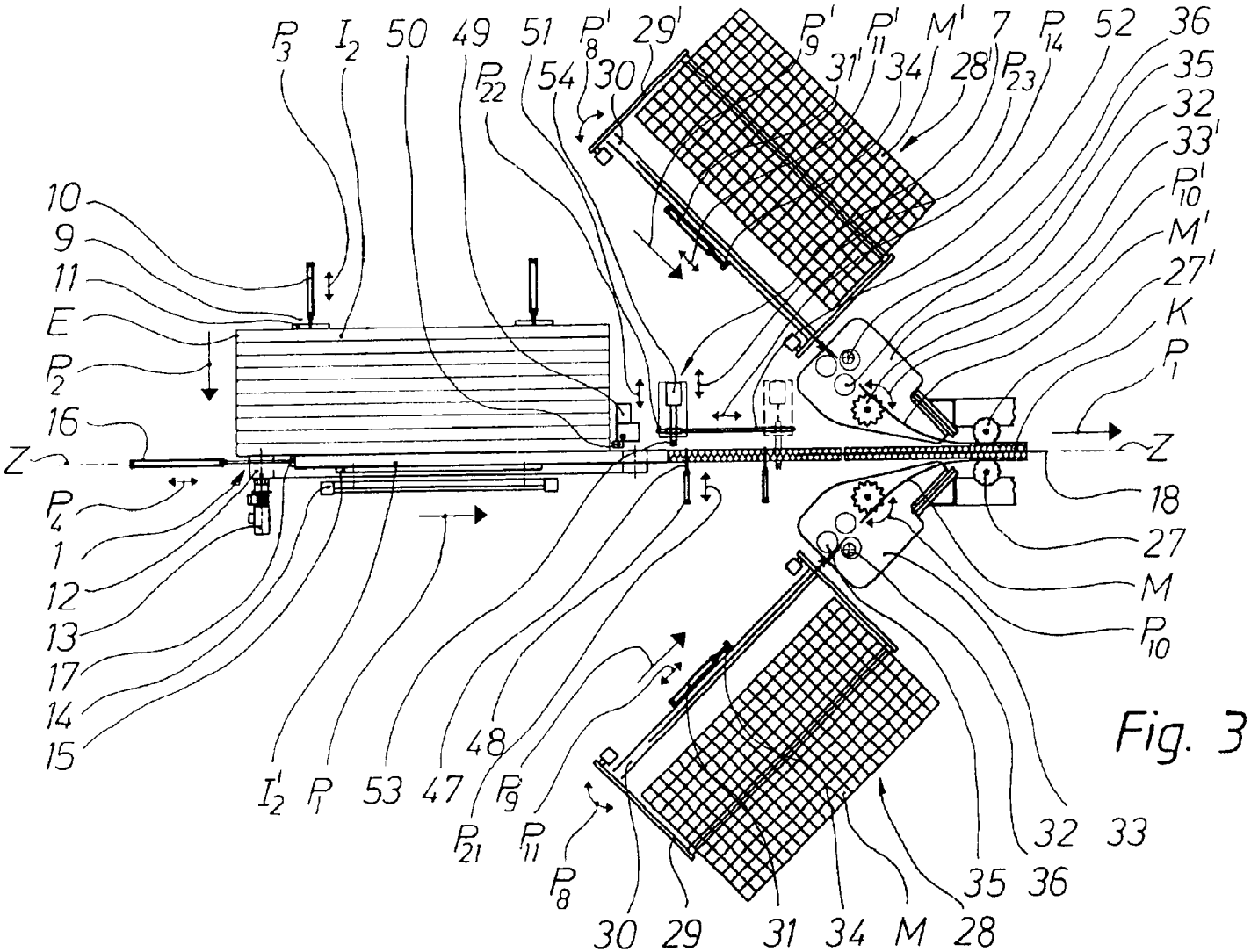

Further characteristics and advantages of the invention are described in more detail below from practical examples with reference to the drawings. These show:

FIG. 1 a schematic top view of an apparatus according to the invention;

FIG. 2 a further practical example of feeding the material to the apparatus according to the invention and FIG. 3 a further practical example of feeding the material to the apparatus according to the invention.

The apparatus shown in FIG. 1 serves for the continuous manufacture of a structural member P consisting of two parallel, flat wire mesh mats M, M' comprising longitudinal and transverse wires L and Q intersecting with each other and welded together at the points of intersection, straight link wires S, S' which keep the two wire mesh mats M, M' a predetermined distance apart and run obliquely between the wire mesh mats M, M' and which at each end are welded to a wire L or Q of the two wire mesh mats M, M', and a dimensionally stable insulating body K arranged between the wire mesh mats M, M' and a predetermined distance from the latter, for example a foamed plastic panel. The structure and technical properties of a structural member P of this kind are described in detail in application WO 94/28264, for example.

The apparatus consists, seen in the direction of production P1, of an insulating material feeder 1, a wire mesh web feeder 2, a wire mesh mat feeder 3', two link wire feeders 4, 4', two link wire welding devices 5, 5', two trimming devices 6, 6', a cutting device 7 for cutting through the web of insulating material B and a structural member conveying device B.

The insulating material feeder 1 comprises an insertion device 9 which supplies the apparatus with the insulating panels I1 designed to form the insulating body K of the structural member P, in the arrow direction P2 of the production line Z—Z. The insulating panels I1 are provided with a groove N on one face and with a tongue F on the other, opposite face, groove and tongue being designed in such a way that the tongue of one insulating panel I1 fits in form-locking and force-locking relationship in the groove of another insulating panel. The insertion device 9 consists of two work cylinders whose piston rods are moved according to the double arrow P3 and are provided with a pressure plate 11 at their end. On the production line Z—Z is arranged a conveyor belt 12 which is drivable in the direction of production P1 with the aid of a conveying drive 13 and advances the insulating panel I1 in this direction along the production line Z—Z. Fixed to a frame 14 is a transversely slidable stop frame 15 which limits the feed movement P2 of the insulating panels I1 and precisely fixes the position of the insulating panels I1 on the production line Z—Z. On the input side of the conveyor belt 12 is arranged an advance mechanism 16, for example a work cylinder. The piston rod of the work cylinder 16 is movable according to the double arrow P4 and provided with a contact pressure plate 17 adapted to the grooved face of the insulating panel I1. By means of the advance mechanism 16 the insulating panel I1' which is located on the conveyor belt 12 is additionally advanced according to the arrow P1 in order to move the insulating panel I1' relative to the web of insulating material B already formed and so join the insulating panel I1' in form-locking and force-locking relationship to the end of the web of insulating material B and produce an endless, coherent web of insulating material B. In the process the tongue of the insulating panel I1' engages in the groove of the end element of the web of insulating material B. The grooves and tongues are coordinated with each other in their design in such a way that a form-locking and force-locking joint is formed, which ensures both alignment of the insulating panels I1, I1' to be joined and rigid joining thereof.

The conveyor belt 12 is followed by a transport chain 18 which extends over the whole production line Z—Z and which is drivable in the direction of production P1 and moves the web of insulating material B on the production line Z—Z cyclically in the direction of production P1. The junction between the conveyor belt 12 and the beginning of the transport chain 18 is bounded laterally by side plates 19, 19' in order to avoid lateral yielding of the insulating panels I1' when joining adjacent insulating panels I1' to form the web of insulating material B. The distance between the side plates 19, 19' is adjustable in order to ensure guiding as narrowly as possible even with different thicknesses of the insulating panels I1'. Within the scope of the invention it is possible to provide additional clamping elements which engage the web of insulating material B and which, when the insulating panel I1' is joined to the already formed web of insulating material B, additionally fixes the latter.

From a storage reel 20 a wire mesh web G standing edgewise is taken off in the arrow direction P5 by means of an advance roller 21 drivable according to the double arrow P6, and fed to a straightening device 22. The straightening device 22 consists of two rows of straightening rollers 23 and adjustable eccentric rollers 24 offset from each other. By means of the advance rollers 21 the wire mesh web G is fed stepwise to a cutting, device 25 which essentially comprises a cooperating pair of cutter bars 26 and cuts wire mesh mats M of predetermined length off an endless wire mesh web G. The cutting device 25 in the embodiment shown works so as to cut a selectable piece out of the wire mesh web G in a so-called Gassel cut, so that the wire mesh mats M fed to the production line Z—Z succeed each other at a distance. Within the scope of the invention, however, it is also possible to design and control the cutting device 25 in such a way that a separating cut or trimming cut is performed.

The wire mesh mat M passes via guide devices, not shown, onto the production line Z—Z and is there fed in the direction of production P1 stepwise along the production line Z—Z together with the web of insulating body B to the subsequent processing devices 4, 4'; 5, 5' and 6, 6', at a distance from and parallel to the web of insulating material B, by means of two pairs of conveying elements 27, 27' drivable according to the arrows P7, P7'.

From a stack 28' of mats, wire mesh mats M' are taken successively by means of a transporter 29' which is pivotable according to the double arrow P8', and deposited in a receiving rail 30. By means of an insertion device 31' the wire mesh mats M' are successively fed in the arrow direction P9' via a shaping device 32' to an advance roller 33' drivable according to the double arrow P10'. The insertion device 31' consists for example of a work cylinder whose piston rod is movable according to the double arrow P11' and which is provided with a gripper 34 for picking up the wire mesh mat M'. The shaping device 32' comprises shaping rollers 35 and eccentric rollers 36 offset from each other. The advance roller 33' pushes the wire mesh mats M' successively stepwise onto the production line Z—Z where they are fed, at a distance from and parallel to the web of insulating material B and together with the latter, by means of the pairs of conveying elements 27, 27' in the direction of production P1 stepwise along the production line Z—Z to the subsequent processing devices 4, 4'; 5, 5' and 6, 6'.

In the link wire feeders 4, 4', several link wires S, S' are fed simultaneously from both sides in the arrow directions P12 and P12' and pushed in a horizontal direction at a selectable angle through the holes in the wire mesh mats M, M' and through the web of insulating material B, wherein the link wires S, S' abut by both their ends respectively against the corresponding wires L or Q of the wire mesh mats M, M', slightly projecting laterally. The link wires S, S' can within the scope of the invention be separated from a wire store by means of suitable shears or fed to the link wire feeders 4, 4' as straightened rods already cut to length.

By means of the pairs of conveying elements 27, 27' the wire mesh mats M, M' are fed together with the web of insulating material B advanced with the transport chain 18, with the link wires S, S' assembled, to the subsequent link wire welding devices 6, 6' in which the link wires S, S' are welded respectively to the corresponding wires L or Q of the wire mesh mats M, M'. The mesh body H formed in this way together with web of insulating body B is fed, by means of two pairs of conveying elements 37, 37' drivable in the arrow directions P13, P13', to the subsequent trimming devices 6, 6' in which the link wire ends projecting beyond the wires L or Q of the wire mesh mats M, M' are cut off level.

By means of the pairs of conveying elements 37, 37' the mesh body H together with the web of insulating material B is fed to the cutting device 7. The cutting device 7 cuts off the insulating body K in a selectable length from the web of insulating material B and comprises at least one separating disc 39 drivable with a cutting drive 38. To increase the cutting output a further separating disc 39' together with drive 37' may be used. The cutting device 7 is moved during cutting synchronously with the advance movements of the pairs of conveying elements 27, 27' and 37, 37' in the direction of production P1 and, after cutting is done, returned to the starting position, these movements being effected according to the double arrow P14. The movement into the cutting position and the corresponding return from the cutting position are effected according to the double arrow P15. The length of the insulating body K can within the scope of the invention correspond exactly to the length of the wire mesh mats M, M', so that the cutting device 7 in a so-called Gassel cut must cut a corresponding piece out of the web of insulating material B. However, it proved advantageous to let the insulating body K protrude slightly beyond the wire mesh mats M, M', with the result that, on using the structural members P, almost continuous insulation is achieved in the walls formed from the structural members P.

The finished structural member P is fed to a transverse conveyor 42 along the production line Z—Z by a transporter 41 provided with a suitably constructed gripper 40. The transporter 41 can for example consist of a work cylinder whose piston rod is movable according to the double arrow P16. The transverse conveyor 42 pushes the finished structural members P in the arrow direction P17 off the production line Z—Z. The transverse conveyor 42 consists for example of two work cylinders whose piston rods are movable according to the double arrow P18 and each provided with a transfer plate 43.

In FIG. 2 is shown schematically the input region of a further embodiment of an apparatus according to the invention. According to this embodiment insulating panels I2 which, compared with the insulating panels I1, I1' described in FIG. 1, have plane faces E are used. The insulating panels I1 are fed to the production line Z—Z onto the conveyor belt 12 via the insertion device 9. To produce an endless web of insulating material B, the insulating panel I2' is joined to the web of insulating material B by hot welding by means of a heating device 44. The heating device 44 essentially consists of a heating plate 45 and a heating transformer 46 which serves to heat up the heating plate 45.

The endless web of insulating material B is produced in the following manner: the insulating panel I2' located on the conveyor belt 12 is advanced according to the arrow P1 by means of the advance mechanism 16 until the insulating panel I2' impinges on the heating plate 45 abutting against the end face of the web of insulating material B. The heating plate 45 is then heated up by means of the heating transformer 46 until the abutting faces of the web of insulating material B and of the insulating panel I2' are softened. The heating plate 45 is then quickly pulled out of the gap between the insulating panel I2' and the web of insulating material B in the corresponding arrow direction of the double arrow P19 and the insulating panel I2' is advanced slightly in the direction of production P1 by means of the advance mechanism 16 in order to press the heated faces against each other and so weld the insulating panel I2' to the web of insulating material B and so join them in form-locking and force-locking relationship. As the web of insulating material B during the joining operation is advanced by the conveyor belt 12 stepwise, in time with the whole production apparatus in the direction of production P1, the heating device 44 during heating is also simultaneously moved stepwise in the corresponding arrow direction of the double arrow P20 and, after the heating plate 45 is pulled out, moved back to the starting position in the corresponding opposite direction of the double arrow P20.

Within the scope of the invention it is possible, as shown in FIG. 2, to arrange the cutting device 7 for cutting through the web of insulating material B directly behind the heating device 44 and ahead of feeding of the wire mesh mats M, M' onto the production line Z—Z. As the cutting device 7 is also, when the web of insulating material B is cut through, advanced by the conveying chain 18 stepwise in time with the whole production apparatus in the direction of production P1, the cutting device 7 is also moved stepwise during cutting in the corresponding arrow direction of the double arrow P14 and, after cutting is over, moved back to the starting position in the corresponding opposite direction of the double arrow P14. The conveying chain 18 conveys the insulating bodies K cut off the web of insulating material B in the direction of production P1 into the subsequent processing devices of the apparatus.

As the conveying chain 18 must not extend into the paths of movement of the heating device 44 and cutting device 7, the web of insulating material B is supported in this region by at least two support elements 47 which can be moved by means of a work cylinder 48 according to the double arrow P21 out of the path of movement of the heating device 44 and cutting device 7.

Within the scope of the invention it is possible, as shown in FIG. 2, to provide two storage reels 20, 20' with wire mesh webs G, G' in order to produce the wire mesh mats M, M'. The corresponding elements in this case have the same reference numbers, which are in each case provided with or without apostrophe.

In FIG. 3 is shown schematically the input region of a further embodiment of an apparatus according to the invention. According to this embodiment, the insulating panels I2 already described in FIG. 2 are used likewise. The insulating panels I2 are fed to the production line Z—Z onto the conveyor belt 12 via the insertion device 9. To produce an endless web of insulating material B, the insulating panel I2' is joined to the web of insulating material B by adhesion by means of an adhesive device 49. The adhesive device 49 comprises an injection nozzle 50 together with storage receptacle which is filled with a suitable adhesive The adhesive must be suitable for adhesion of the material of the insulating panels I2 and have a drying time tailored to the production speed in order to ensure reliable joining of the insulating panel I2' to the web of insulating material B. The adhesive device 49 is movable according to the double arrow P22 in the horizontal direction and in the vertical direction. To spray the adhesive onto the face E of the insulating panel I2, the adhesive device 49 is moved in these directions of movement. In order to accelerate application of the adhesive, several adhesive devices 49 can be used simultaneously within the scope of the invention. Within the scope of the invention it is also possible to spray several insulating panels I2 simultaneously with adhesive.

The endless web of insulating material B is produced in the following manner: immediately before feeding the insulating panel I2 onto the production line Z—Z, one face E of the insulating panel I2 is provided with adhesive. The insulating panel I2 is advanced by means of the feeder 1 first in the arrow direction P2 onto the production line Z—Z and deposited on the conveyor belt 12. Then the insulating panel I2' is advanced slightly by means of the advance mechanism 16 in the direction of production P1 in order to press the adhesive-coated face of the insulating panel I2' against the end face of the insulating material B and so join the insulating panel I2' to the web of insulating material B.

In FIG. 3 is shown a further embodiment of a cutting device 7 for separating the insulating body K from the web of insulating material B. The cutting device 7 comprises a straight carriage 51 which is slidable according to the double arrow P14 along a rail 52, the movement in the direction of production P1 taking place synchronously with advance of the web of insulating material B. Attached to the straight carriage 51 is a cutting wire 53 which is movable transversely to the web of insulating material B according to the double arrow P23 and heatable by means of a heating transformer 54. To separate the insulating body K from the web of insulating material B, the heated cutting wire 53 is moved correspondingly by the web of insulating material B and passes into the position shown in broken lines in FIG. 3. After cutting, the straight carriage 51 together with cutting wire 53 is moved back into its starting position.

Within the scope of the invention it is possible to replace the cutting device 7 shown in FIG. 1 with the cutting device described above, i.e. to arrange the cutting device described above after the trimming devices 6, 6'.

Within the scope of the invention it is possible, as shown in FIG. 3, to provide two stacks 28, 28' of wire mesh mats M, M'. The corresponding elements in this case have the same reference numbers, which are in each case provided with or without apostrophe.

It goes without saying that the embodiments shown within the scope of the general concept of the invention can be modified variously, particularly with respect to the design and construction of the devices for joining the insulating panels to form an endless web of insulating material. When using suitable adhesives, both the face of the insulating panel and the end face of the web of insulating material can be provided with adhesive.

Furthermore within the scope of the invention it is possible to provide one or both of the plane faces of the insulating panels to be joined, with a self-adhesive film. The film can be mounted already during manufacture of the insulating panels and is appropriately protected by a removable film.

Furthermore within the scope of the invention it is possible to provide the grooved and tongued faces of the insulating panels with an adhesive in addition, in order to ensure reliable joining of the insulating panels.

The faces of the insulating panels which are adjacent for forming the web of insulating material can within the scope of the invention also be provided with other clamp joining elements which cooperate in form-locking and force-locking relationship, which are for example dovetailed.

Furthermore within the scope of the invention it is possible to use other cutting methods and devices to separate the insulating body from the web of insulating material. These methods and devices must be adapted to the material properties of the insulating materials and ensure that cutting yields edges as smooth as possible, and the material of the insulating body is not impaired in its properties, for example melted.

What is claimed is:

1. Method for the continuous manufacture of structural members, in which two parallel, flat wire mesh mats comprising longitudinal and transverse wires intersecting with each other and welded together at the points of intersection are advanced on a production line and between the wire mesh mats is introduced an insulating body, whereupon the straight link wires are passed through the insulating body and with their ends welded to the wire mesh mats, so that the wire mesh mats are held a predetermined distance apart, comprising:

producing an endless, coherent web of the insulating material (B) from individual insulating panels (I1, I1'; I2, I2') and said web being introduced between the wire mesh mats;

advancing said web of insulating material along with the wire mesh mats; and then cutting a selectable length of the insulating body (K) off said web of insulating material (B).

2. Method according to claim 1, wherein the web producing step comprises conveying the insulating panels (I1, I1'; I2, I2') singly and successively onto the production line (Z—Z) to be displaced relative to each other in their longitudinal direction (P1) to produce the web of insulating material (B) such that the faces (N, F; E) of the adjacent insulating panels (I1, I1') are joined together in form-locking and force-locking relationship to form the web of insulating material (B).

3. Method according to claim 1, characterized in that, to produce the endless, coherent web of insulating material (B), the insulating panels (I1, I1') are joined together with their faces (N, F) in form-locking and force-locking relationship by clamping.

4. Method according to claim 3, characterized in that the faces (N, F) are joined together in form-locking and force-locking relationship by a tongue and groove clamping joint.

5. Method according to claim 3, characterized in that the faces (N, F) are provided with an adhesive.

6. Method according to claim 1, characterized in that insulating panels (I2, I2') with plane faces (E)a are used and, to produce the endless, coherent web of insulating material (B), an adhesive is applied to at least one face (E) of adjacent insulating panels (I2, I2') or the face is provided with a self-adhesive film.

7. Method according to claim 1, characterized in that insulating panels (I2, I2') with plane faces (E) are used and, to produce the endless, coherent web of insulating material (B), the face (E) of one insulating panel (I2') and the end face of the web of insulating material (B) are heated together and joined by welding.

8. Apparatus for carrying out the method according to claim 1, with two storage magazines for wire mesh webs, with straightening and cutting devices for each wire mesh web, with a feeder for insulating panels, with at least one assembly of link wire storage reels together with associated link wire feeders and cutting devices, with link wire welding devices, with link wire trimming devices, and with several conveying devices coupled together for the insulating body, for the wire mesh webs or for wire mesh mats for the mesh body and for the structural member, characterized in that an advance mechanism (16) for the displacement of insulating panels (I1, I1'; I2, I2') relative to a web of insulating material (B) for the purpose of forming a form-locking and force-locking joint between the insulating panels (I1, I1'; I2, I2') and the web of insulating material (B), and a cutting device (7) displaceable parallel to the production line (Z—Z) for cutting an insulating body (K) off the web of insulating material (B), are provided.

9. Apparatus according to claim 8, characterized in that the cutting device (7) comprises at least one drivable separating disc (39) movable in horizontal and vertical directions.

10. Apparatus according to claim 8, characterized in that the cutting device (7) comprises a cutting wire (53) which is displaceable transversely to the web of insulating material (B) and heatable by means of a heating transformer (54).

11. Apparatus according to claim 8, characterized in that, to produce the web of insulating material (B), there is provided a heating plate (45) with which the face (E) of one insulating panel (I2') and the end face of the web of insulating material (B) can be heated together.

12. Apparatus according to claim 8, characterized in that, to produce the web of insulating material (B), there is provided at least one adhesive device (49) which is movable in horizontal and vertical directions and with which at least one face (E) of adjacent insulating panels (I2') can be provided with an adhesive coat.

13. Apparatus according to claim 8, characterized in that the cutting device (7) is arranged behind the trimming devices (6, 6') in the direction of production.

14. Apparatus according to claim 8, characterised in that the cutting device (7) is arranged in front of the conveying device (18) for the insulating body (K) and in that in the region between the feeder (I2) for the insulating panels (I1, I2') and the conveying device (18) for the insulating body (K) are provided support elements (47) movable into the path of advance of the web of insulating material (B).

15. Apparatus according to claim 8, characterized in that a transporter (29, 29') is provided for taking wire mesh mats (M, M') already cut to length from at least one stack of mats (28, 28'), and an insertion device (31, 31') is provided for insertion of the wire mesh mats (M, M') in a shaping device (32, 32') and a drivable advance roller (33, 33') is provided for insertion of the straightened wire mesh mats (M, M') in the production line (Z—Z), wherein the advance roller (33, 33') is coupled to the conveying device (12) for the web of insulating material (B) and the insulating body (K), the conveying devices (27, 27') for the wire mesh mats (M, M'), the conveying devices (37, 37') for the mesh body (H) and to the advance roller (21, 21') for a wire mesh web (G, G').

* * * * *